US005472745A

United States Patent [19]

Schroeder et al.

[11] Patent Number: 5,472,745

[45] Date of Patent: Dec. 5, 1995

[54] PROCESS FOR PRODUCING PLASTIC LAYERS ON GAP SEALING SURFACES WHICH ARE UNAFFECTED BY TEMPERATURE CHANGES

[75] Inventors: Johannes Schroeder; Joachim Soehngen; Christian Heinzelmaier, all of Munich, Germany

[73] Assignee: MTU Motoren- Und Turbinen Union Muenchen GmbH, Munich, Germany

[21] Appl. No.: 232,031

[22] PCT Filed: Aug. 7, 1993

[86] PCT No.: PCT/EP93/02108

§ 371 Date: Jun. 14, 1994

§ 102(e) Date: Jun. 14, 1994

[87] PCT Pub. No.: WO94/04283

PCT Pub. Date: Mar. 3, 1994

[30] Foreign Application Priority Data

Aug. 25, 1992 [DE] Germany ..... 42 28 196.2

[51] Int. Cl.[6] ..... B05D 1/08

[52] U.S. Cl. ..... 427/447; 427/449; 427/453

[58] Field of Search ..... 427/447, 449, 427/453

[56] References Cited

U.S. PATENT DOCUMENTS

| | | | |
|---|---|---|---|
| 2,570,649 | 10/1951 | Davidoff | 427/447 |
| 3,723,165 | 3/1973 | Longo et al. | 106/1 |
| 4,349,313 | 9/1982 | Munroe et al. | 415/174 |
| 5,196,471 | 3/1993 | Rangaswamy et al. | 524/406 |
| 5,304,032 | 4/1994 | Bosna et al. | 427/447 |

FOREIGN PATENT DOCUMENTS

| | | | |
|---|---|---|---|
| 2041798 | 4/1970 | France . | |
| 2615022 | 4/1976 | Germany . | |
| 3640906 | 11/1986 | Germany . | |
| 4015009 | 5/1990 | Germany . | |
| 4125157 | 7/1991 | Germany . | |
| 623753 | 8/1976 | Switzerland . | |
| 708352 | 5/1954 | United Kingdom | 427/447 |
| 2242143 | 3/1990 | United Kingdom . | |

*Primary Examiner*—Shrive Beck
*Assistant Examiner*—Katherine A. Bareford
*Attorney, Agent, or Firm*—Evenson, McKeown, Edwards & Lenahan

[57] ABSTRACT

A process for producing plastic layers on gap sealing surfaces which are unaffected by temperature changes is provided. Plasma or acetylene oxygen flame is generated by a plasma or flame spraying burner, which melts a plastic mass under a cooling gas flow of from 40 to 150 SLpM and sprays it onto a gap sealing surface. Coatings produced by this process have dense to porous layer structures and, when polyphenylene sulfides are used as the plastic material, may be used up at to temperatures of 250° C.

14 Claims, 1 Drawing Sheet

PROCESS FOR PRODUCING PLASTIC LAYERS ON GAP SEALING SURFACES WHICH ARE UNAFFECTED BY TEMPERATURE CHANGES

BACKGROUND AND SUMMARY OF THE INVENTION

This invention relates to a process for producing plastic layers on gap sealing surfaces. The plastic surfaces are unaffected by temperature changes.

The efficiency of turbo engines is a direct function of the gap size between the housing and the rotor. A minimal gap size is achieved, for example, by a touching action of the blade tips on the gap sealing surfaces. When the blade tips touch the gap sealing surfaces, damage to the blade must be avoided. Plastic layers on gap sealing surfaces have the purpose of rendering the gap widths in an engine abradable and therefore adjustable without any significant abrasion of the blade tips. For this purpose, the plastic material is converted to a viscous mass and is knifed onto the stressed housing rings. In a further state of the art, prefabricated plastic inlet coatings are glued onto the housing rings. The adhesive and the primer must then harden. The plastic inlet coatings may also be cast on.

One disadvantage of these processes are high manufacturing expenditures, in the case of which a base must be applied after the cleaning onto which, after a heat treatment step, the plastic mass is glued, knifed or cast, and is then hardened. Then a cutting process takes place. Defects in the coating which become visible must be knifed out and hardened as well as refinished.

In the case of knifed, glued or cast-on plastic masses, the present maximal usage temperature is 180° C.

The preparation of the individual components for the knifing or gluing requires additional manufacturing expenditures, in which case it is a disadvantage that the components have a limited storage time. Knifed, glued or cast-on plastic masses cannot be varied with respect to the buildup of their coating and are usually dense throughout the mass. This may have a harmful effect on the abrasion behavior during the touching action.

It is an object of the present invention to provide a process of the above-mentioned type by means of which, in one processing step, a gradual transition from a dense to porous mass can be provided in the plastic coating close to the surface for gap sealing surfaces. Thus, the disadvantages of the previous processes are overcome.

This object is achieved in that a plasma or acetylene oxygen flame is generated by a plasma or flame spraying burner and, below a cooling gas flow of from 40 to 150 SLpM, the flame melts a plastic mass and sprays it on a gap sealing surface.

It is an advantage of this process that coatings can be generated which have different porosities and hardnesses, and the coating characteristics can be still varied during the manufacturing operation so that the degree of porosity can be changed from 0 to 85% by volume in one operation and in one layer. Furthermore, the plastic structure created after the spraying is extremely homogeneous. Finally, this process is faster and therefore also lower in cost than the gluing, knifing or cast-on processes.

Advantageously, the strength of the cooling gas flow during the spraying time is varied for manufacturing sprayed layers that vary from being denser to porous. This has the advantage that no additional devices are required and no bubble-forming or foaming agents must be added to the plastic material.

In a preferred implementation of the invention, the plastic mass is added in powder form. This powder form is particularly advantageous in the case of flame spraying because powder particles can be converted uniformly into particle droplets by means of the flame.

In a further preferred implementation of the invention, the plastic mass is added as plastic wire. Plastic wire is advantageously suitable for a flame spraying process because the plastic droplets do not tear off the tip of the wire and spray onto the surface to be coated before they are in a highly plastic or liquid condition.

As the preferred plastic mass, polyphenylene sulfides are used which advantageously permit usage temperatures of up to 260°. This is because a softening of this plastic mass does not start before 275° C. is reached.

Preferably, up to 60% by volume fillers may also be added to the plastic mass. These fillers improve the touching behavior of the mass.

Preferably, calcium fluoride, zince oxide, magnesium oxide, or mixtures thereof are added as fillers. These are used particularly advantageously if, in the start-up phase of the engine, the blade tips are to be ground-in on the gap sealing surfaces.

Other objects, advantages and novel features of the present invention will become apparent from the following detailed description of the invention when considered in conjunction with the accompanying drawings.

DETAILED DESCRIPTION OF THE DRAWINGS

EXAMPLE 1

On a ring of the housing of an engine, in the area of the compressor, a hot gas flame from a flame spraying burner was aimed at the basic material 1 of the ring by means of 2 to 8 SLpM (standard liter per minute) oxygen and 2 to 8 SLpM acetylene ($C_2H_2$). Under a cooling air flow of 40 SLpM, with additionally 1 to 5 SLpM nitrogen, a plastic mass of a rate of from 7 to 40 g/min was melted and was sprayed into the interior ring side as the gap sealing surface at a distance of from 50 to 200 mm.

Figure 1:
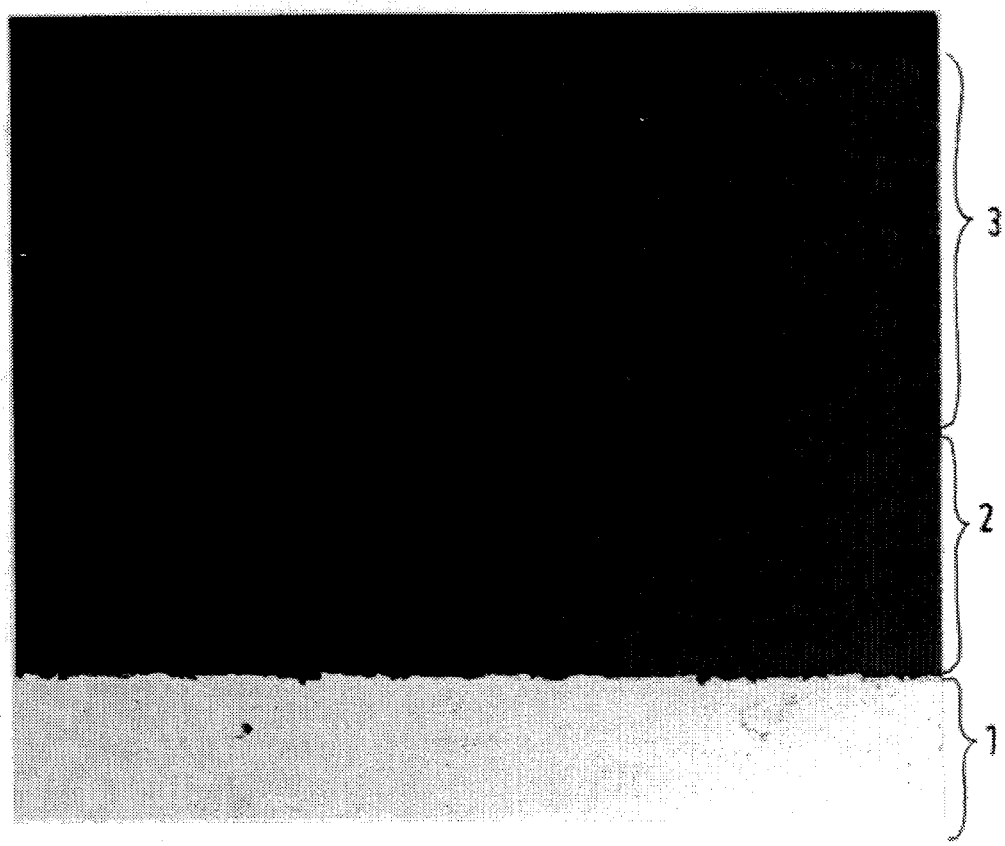
FIG. 1 is a ground section of a flame-sprayed plastic layer on a gap sealing surface which is not affected by temperature changes.

FIG. 1 illustrates the ground section of this flame-sprayed plastic layer which is not affected by temperature changes on a gap sealing surface. By means of the increase of the cooling gas flow during the spraying time to 150 SLpM, the dense sprayed layer 2 was converted to a porous sprayed plastic layer 3 located close to the surface. This preferred layer structure made of polyphenylene sulfides has the advantage that, when the layer on the gap sealing surface is touched, first the less resistant porous layer is to be abraded from the blade tips and as a result, the blades tips are advantageously spared.

EXAMPLE 2

In a further example, the porous area is compressed with a ceramic filler by means of a slip process so that an abrasive touch coating is created which has the object of grinding the blade tips in the inlet phase down to the same measurement so that a minimal gap width is obtained.

EXAMPLE 3

In this example, before the spraying process, 25% by volume $C_aF_2$-powder is admixed to the plastic powder as a filler which is then sprayed on together with the plastic material. During the spraying-on operation, the strength of the cooling gas flow is adjusted such that a thick plastic layer is obtained with embedded $C_aF_2$-particles.

EXAMPLE 4

In this example, the layer is produced by means of plasma spraying. For this purpose, a cooling gas flow of 90 to 140 SlpM consisting of argon is used, together with a secondary gas flow of hydrogen of from 5 to 10 SLpM. As a propellant gas, 5 to 10 SlpM argon is added, and the plastic layer is produced on a gap sealing surface at a distance of from 60 to 160 mm from the plasma burner.

Figure 2:
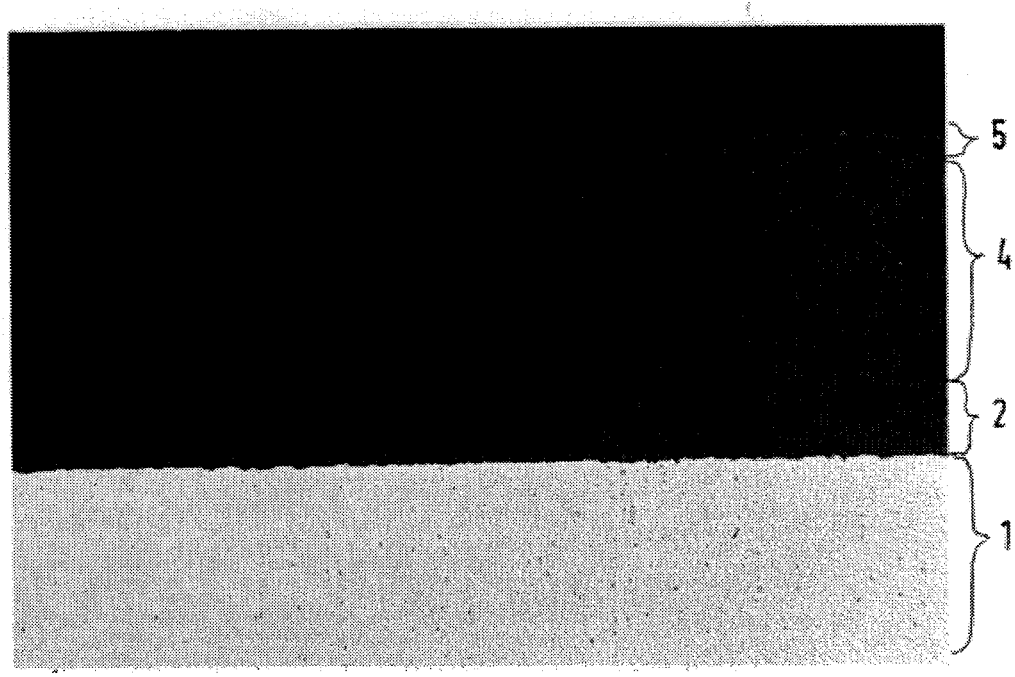
FIG. 2 is a ground section of a plasma-sprayed plastic layer on a gap sealing surface which is not affected by temperature changes.

FIG. 2 is a ground section of this plasma sprayed plastic layer, on a gap sealing surface which is made of polyphenylene sulfides and is not affected by temperature changes. The dense sprayed layer 2 was changed to a porous intermediate layer 4 by increasing the cooling gas flow from 100 SLpM argon to 140 SLpM argon. By means of the reduction of the cooling gas flow to 90 SLpM argon toward the end of the process, a dense and extremely smooth cover layer 5 was formed.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A process for producing plastic layers on gap sealing surfaces which are unaffected by temperature changes after coating of said surfaces, the process comprising the steps of:

generating one of a plasma and acetylene oxygen flame by a plasma or flame spraying burner, respectively;

melting a plastic mass fed into a cooling gas flow of from 40 to 150 SLpM mixed with said plasma or acetylene oxygen flame;

spraying said melted plastic mass onto a gap sealing surface; and varying a gas flow rate of the cooling gas flow during spraying time for producing sprayed layers which vary from dense to porous.

2. A process according to claim 1, wherein said plastic mass is fed as plastic powder.

3. A process according to claim 2, wherein polyphenylene sulfides are used as said plastic mass.

4. A process according to claim 2, wherein said melting step further includes the step of adding a filler of up to 60% by volume to said plastic mass.

5. A process according to claim 2, wherein said melting step further includes the step of adding one of calcium fluoride, zinc oxide, magnesium oxide, and mixtures thereof, to said plastic mass.

6. A process according to claim 1, wherein said plastic mass is fed as plastic wire.

7. A process according to claim 6, wherein polyphenylene sulfides are used as said plastic mass.

8. A process according to claim 6, wherein said melting step further includes the step of adding a filler of up to 60% by volume to said plastic mass.

9. A process according to claim 6, wherein said melting step further includes the step of adding one of calcium fluoride, zinc oxide, magnesium oxide, and mixtures thereof, to said plastic mass.

10. A process according to claim 1, wherein polyphenylene sulfides are used as said plastic mass.

11. A process according to claim 10, wherein said melting step further includes the step of adding a filler of up to 60% by volume to said plastic mass.

12. A process according to claim 10, wherein said melting step further includes the step of adding one of calcium fluoride, zinc oxide, magnesium oxide, and mixtures thereof, to said plastic mass.

13. A process according to claim 1, wherein said melting step further includes the step of adding a filler of up to 60% by volume to said plastic mass.

14. A process according to claim 1, wherein said melting step further includes the step of adding one of calcium fluoride, zinc oxide, magnesium oxide, and mixtures thereof, to said plastic mass.

* * * * *